US007877931B2

(12) United States Patent
Cianetti

(10) Patent No.: US 7,877,931 B2
(45) Date of Patent: Feb. 1, 2011

(54) SUPERSTRUCTURE FOR THE LIFTING OF PANES IN DISPLAY UNITS

(75) Inventor: Alessandro Cianetti, San Pier D'Isonzo (IT)

(73) Assignee: N.E.M. Nord Est Meccanica S.N.C., San Pier D'Isondo Go (IT)

( * ) Notice: Subject to any disclaimer, the term of this patent is extended or adjusted under 35 U.S.C. 154(b) by 713 days.

(21) Appl. No.: 11/794,804

(22) PCT Filed: Jan. 19, 2006

(86) PCT No.: PCT/IT2006/000031

§ 371 (c)(1),
(2), (4) Date: Jul. 6, 2007

(87) PCT Pub. No.: WO2006/077615

PCT Pub. Date: Jul. 27, 2006

(65) Prior Publication Data

US 2008/0047912 A1 Feb. 28, 2008

(30) Foreign Application Priority Data

Jan. 21, 2005 (IT) ..... TS05A0001

(51) Int. Cl.
*E05F 11/24* (2006.01)

(52) U.S. Cl. ..... 49/339; 49/344; 16/286; 312/116; 312/138.1; 312/139; 312/325; 312/326; 312/327; 312/328

(58) Field of Classification Search ..... 49/339, 49/340, 344; 312/116, 138.1, 139, 140.3, 312/140.4, 325, 326, 327, 328; 16/286
See application file for complete search history.

(56) References Cited

U.S. PATENT DOCUMENTS

| | | | | |
|---|---|---|---|---|
| 4,842,349 | A * | 6/1989 | Stenemann | 312/116 |
| 5,112,118 | A * | 5/1992 | Wiehle | 312/116 |
| 5,116,274 | A * | 5/1992 | Artwohl et al. | 312/116 |
| 5,622,414 | A * | 4/1997 | Artwohl et al. | 312/116 |
| 5,639,149 | A * | 6/1997 | Grassmuck | 312/116 |
| 6,634,460 | B1 * | 10/2003 | Hackenberg | 186/59 |
| 7,640,696 | B2 * | 1/2010 | Yingst | 49/152 |

FOREIGN PATENT DOCUMENTS

| | | |
|---|---|---|
| DE | 198 45 741 | 4/2000 |
| WO | 2004/100727 | 11/2004 |

* cited by examiner

*Primary Examiner*—Jerry Redman
(74) *Attorney, Agent, or Firm*—Dowell & Dowell PC

(57) ABSTRACT

The present superstructure involves, for each upright, a spacer section bar (3), a hinge-bearing section bar (6), a hinge (8), a piston (13) that helps to lift the pane (1), and is completed by a gripper (9) for supporting the pane (1), a closing section bar (11) and a gasket; the section bar (3) has a box section so that it can be adjusted to be joined together with the section bar (6); each hinge (8) is fixed to the section bar (6) and at its end to be fixed to the gripper (9), bears conical guides (8.1) suitable for fitting the conical arms (9.1) situated on the gripper (9) itself; a gasket (12) is fixed to the gripper (9); where spherical panes (1) are involved, hinges (15) are used containing a body (15.1) and a connecting piece (15.2) that can be rotated with respects to the body (15.1) so that the panes (1) can be fitted on at different lengths of the circular arc.

7 Claims, 7 Drawing Sheets

SUPERSTRUCTURE FOR THE LIFTING OF PANES IN DISPLAY UNITS

BACKGROUND OF THE INVENTION

1. Field of the Invention

The present invention is used particularly in the field of refrigerated display units. The invention can also be used for heated and ambient units, as well as for displays of any kind of goods, such as jewelry, clothes, and telephones.

2. Description of Related Art

Display units for the sale of foodstuffs and non-foodstuffs contain panes made of glass or plastic material. Their function is to isolate products from the surrounding environment and/or to ensure customers do not remove the products. The panes can be attached to a display unit in a number of ways. For example, the panes can be secured to a frame above them, which is supported by uprights, or to a frame below them, which is fixed to the display unit.

There are a number of known opening systems that make use of an overhanging support frame. The production costs of such systems are often high due to customers' needs, both aesthetic and functional. These opening systems can involve front or back frames, as well as varying opening angles of the panes. The hinges used today have a fixed structure such that each hinge is suited to a pane with a particular opening angle, and the uprights can either be in front or behind. Consequently, a variety of different elements must be used, and thus the production costs of these opening systems are high.

Another common problem is keeping insects and dust out of display units, especially outside of business hours. Certain known opening systems contain at least one gasket, which bridges the gap between the gripper that supports the pane and the closing section bar. However, the gasket is fixed to the closing section bar, and the panes are not always completely tight to each other. Since various display units contain different panes, the gripper supporting a particular pane does not always attach to the pane in the same manner. Therefore, the gasket cannot guarantee air tightness in every case.

SUMMARY OF THE INVENTION

The superstructure for the movement of panes of display units of the present invention provides a solution to the problems of conventional opening systems. The opening system includes an upright containing a section bar that acts as a spacer, a hinge-bearing section bar, at least one hinge, and at least one piston that helps lift the pane. The superstructure also includes a gripper for supporting a pane, a closing section bar, and a gasket.

The section bar that acts as a spacer has fins, which bound a bottom and a top guide. The top guide fits a guide projection from the hinge-bearing section bar, and the hinge-bearing section bar is fixed to the spacer section bar by screws inserted into slots.

Each hinge is fixed to the hinge-bearing section bar and includes conical guides on an end that attaches to the gripper. The conical guides on the hinge receive conical arms on an end of the gripper. The hinge also includes a groove on an arm that points towards the closing section bar. The groove receives one end of the plastic gasket, and the other end of the plastic gasket runs along the closing section bar.

When spherical panes are used, the opening system uses special hinges. Each hinge comprises a body with a base fixed to it, and the base of the gripper sits atop the base of the hinge. Further, the special hinges can vary in shape and size to allow for the use of spherical panes with differing opening angles.

The present superstructure is extremely flexible. The superstructure can be installed with both back and front uprights without affecting the mechanics of the rotational motion and while maintaining the same frame. As a result, customers are offered two very effective possibilities that differ in appearance and cost, as the price is usually higher when back uprights are used.

Another advantage of the superstructure of the present invention is due to the use of a plastic gasket fixed onto the gripper. Since the gasket is mobile along with the gripper, the gasket does not have a fixed point of arrival. Thus, the gasket can be either tight fitting or loose when the pane is closed. Consequently, the gasket provides air tightness and prevents insects, dirt, and coins placed on the change counter from entering the display unit.

BRIEF DESCRIPTION OF THE DRAWINGS

Further characteristics and advantages will become better apparent from the detailed description of a preferred but not exclusive embodiment of a superstructure, according to invention, illustrated only by way of a non-limiting example in the accompanying drawings, wherein.

DETAILED DESCRIPTION OF A PREFERRED EMBODIMENT OF THE INVENTION

Figure 1:
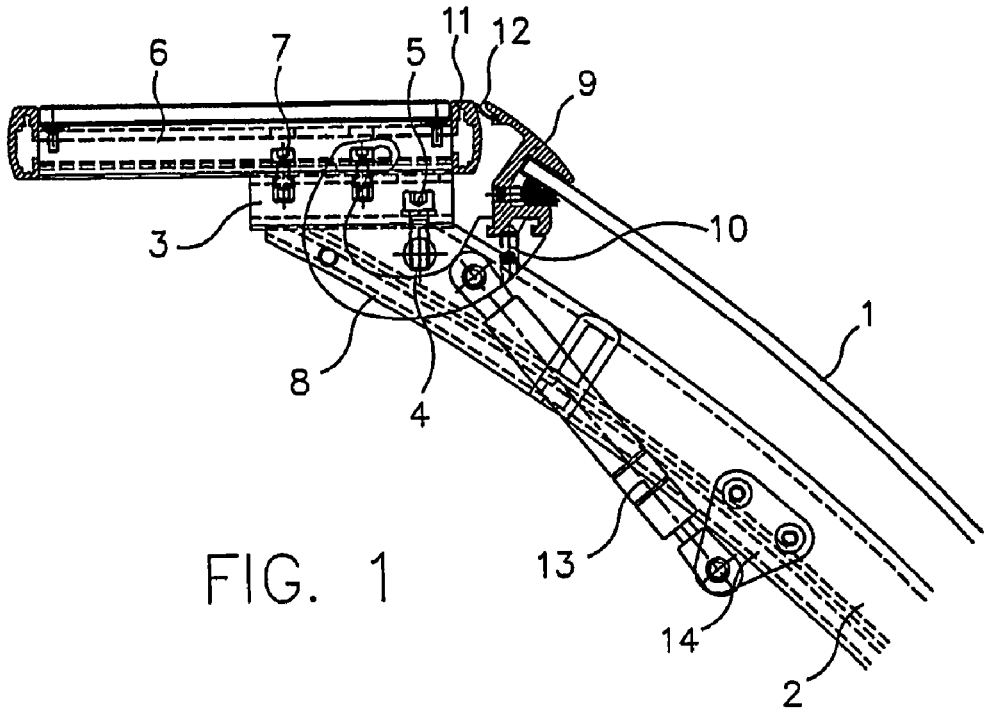
FIG. 1 depicts a section of the present superstructure attached to a side front upright of a display unit.

In the following example of an embodiment the present invention, the superstructure is used on a display unit with a glass pane 1 placed on the customer side.

An upright 2 is fixed to a spacer section bar 3 by means of pin and screws assembly where a pin 4 is inserted into a hole on a front upright 2 and screws 5, having passed through a lower wall of the section bar 3, fit into the pin 4.

Figure 5:
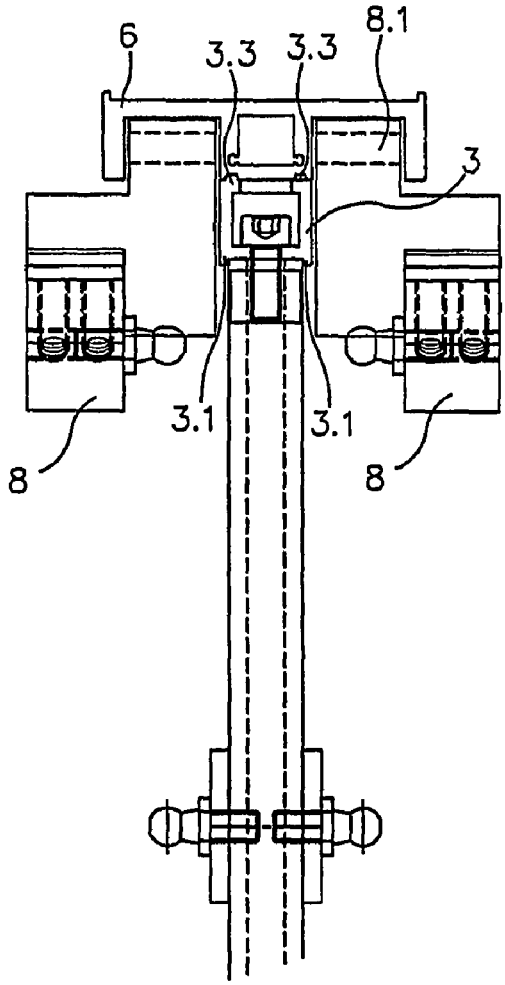
FIGS. 5 and 6 depict front views of two superstructures using, respectively, a central upright and a side upright.
Figure 6:
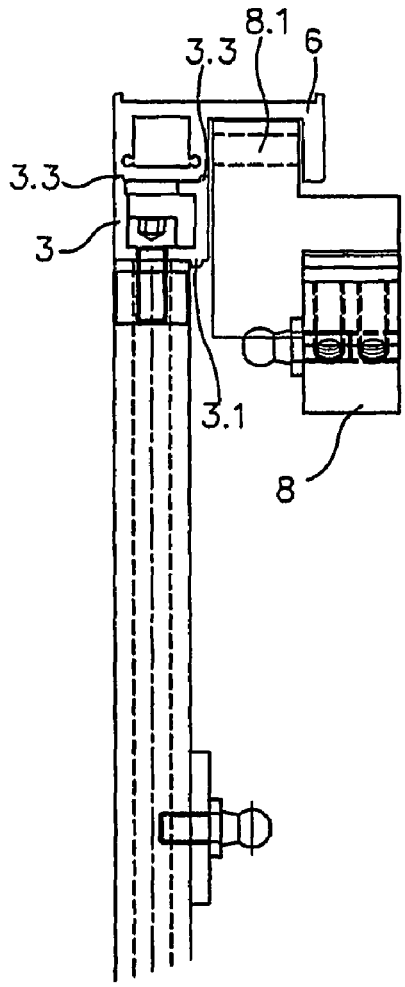
Figure 7:
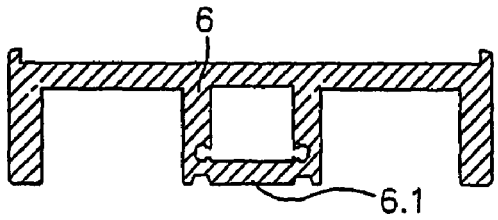
FIG. 7 illustrates, in more detail, a cross section of the hinge-bearing section bar.
Figure 8:
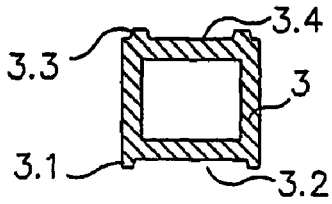
FIG. 8 illustrates, in more detail, a cross section of the spacer section bar.
Figure 9:
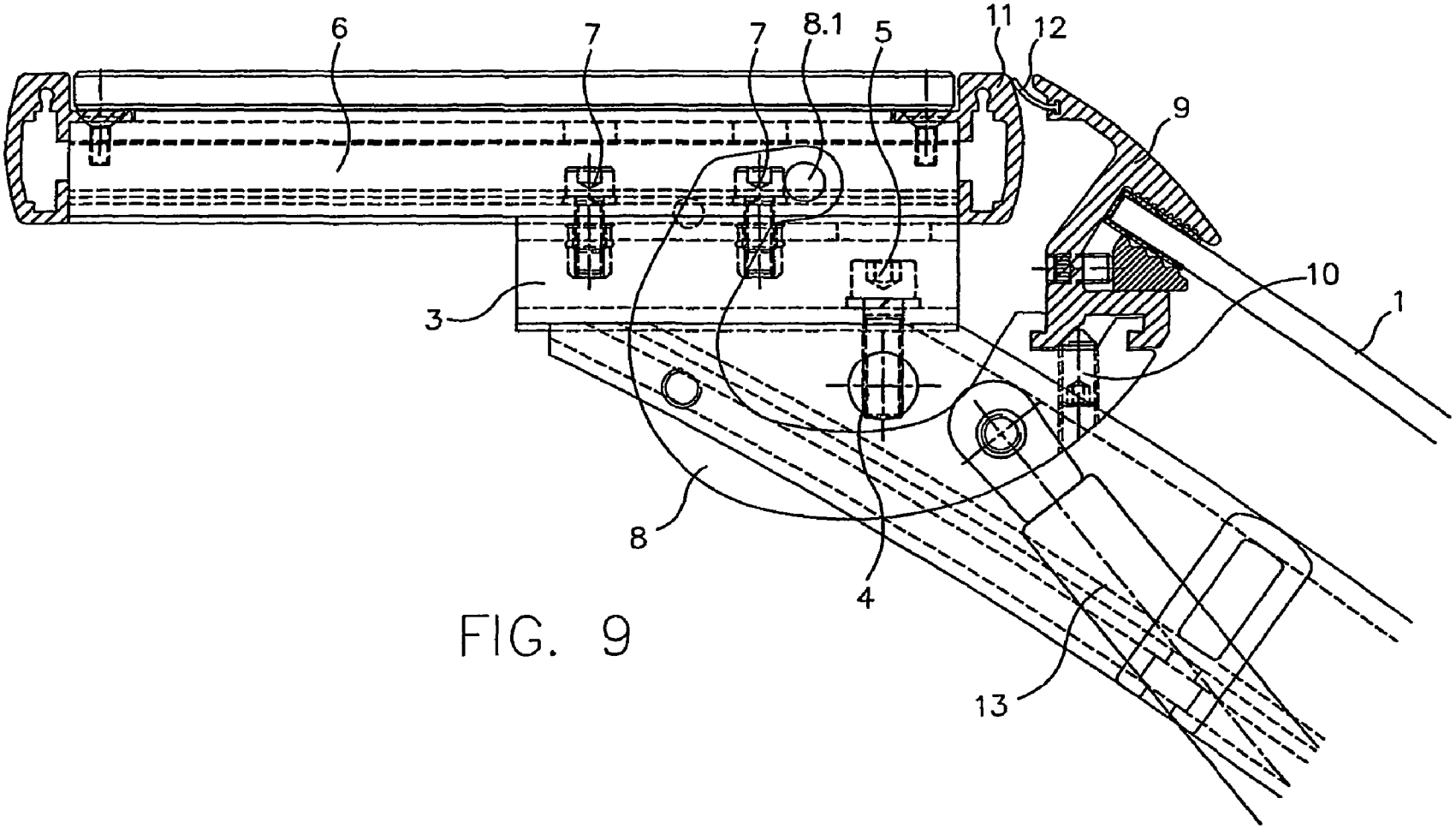
FIG. 9 depicts, in more detail, a section of the superstructure.
Figure 10:
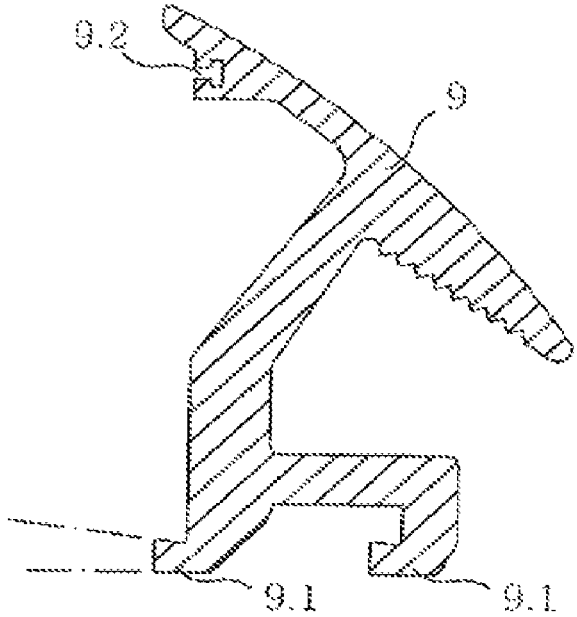
FIG. 10 depicts, in more detail, a cross section of the gripper.
Figure 11:
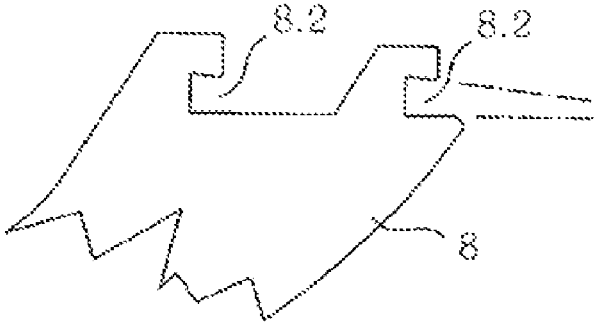
FIG. 11 depicts, in more detail, a view of one end of the hinge.
Figure 12:
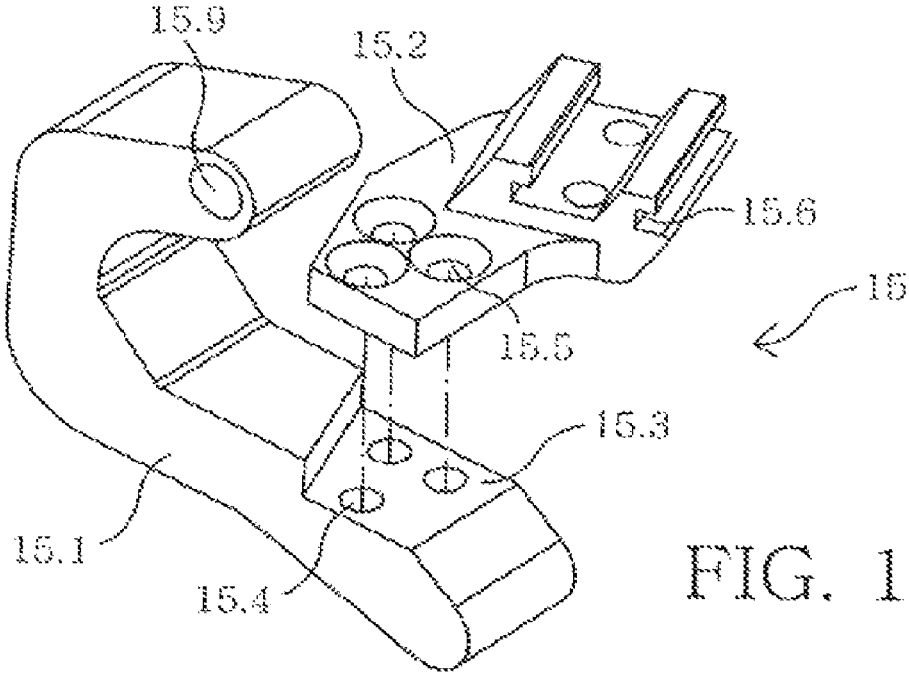
FIG. 12 depicts a blow up of a prospective view of the hinge for curved panes.
Figure 13:
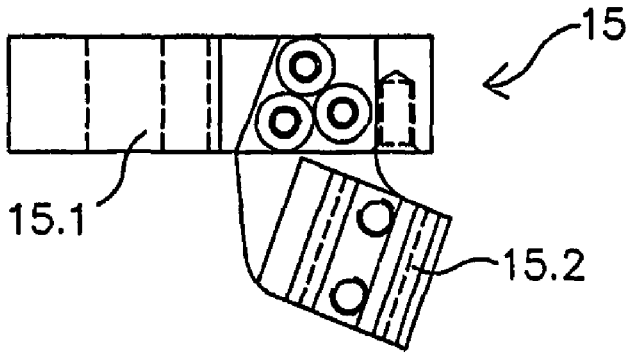
FIG. 13 depicts a top view of the hinge for curved panes.
Figure 14:
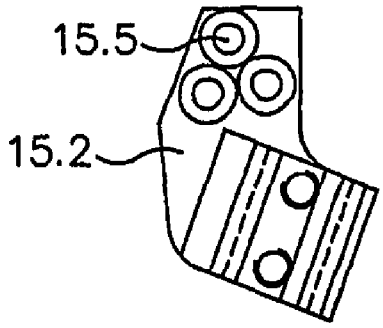
FIG. 14 depicts a top view of the connecting piece for the hinge for curved panes.

The spacer section bar 3, which has a box-shaped section, bears fins 3.1 on its lower side. The fins 3.1 lie parallel to the longitudinal axis of the section bar 3 and bound a bottom guide 3.2. A top end of the upright 2 slides into the bottom guide 3.2. The section bar 3 also bears fins 3.3 on its top side. The fins 3.3 lie parallel to the longitudinal axis of the section bar 3 and bound a top guide 3.4. The lower fins 3.1 can be either present on both sides of the section bar 3, as shown in FIG. 5, or only along one side, as shown in FIG. 6. In the first case, the section bar 3 is used for central uprights. In the second case, the section bar 3 is used for side uprights, either on the left or on the right depending on which side the fins 3.1 lie. The lower guide 3.2 prevents the section bar 3 from rotating on the upright 2 and ensures the section bar 3 and upright 2 are correctly aligned.

A hinge-bearing section bar 6 is fixed above the section bar 3 by means of screws 7. The hinge-bearing section bar 6 includes a guide projection 6.1 on its lower side, and the guide projection 6.1 fits into the top guide 3.4 of the spacer section bar 3. The top guide 3.4 guides the translation of the hinge-bearing section bar 6 with respect to the section bar 3, ensuring the hinge-bearing section bar 6 and spacer section bar 3 are correctly joined together. The two section bars 3 and 6 can thus be very precisely adjusted, and grippers 9 can be correctly aligned at sight. To allow for the precise adjustment of the section bars 3 and 6, screws 7 are inserted through slots situated in the area where the two section bars 3 and 6 join and fasten together.

A hinge 8, which is generally semicircular, is hinged onto the section bar 6 by means of a pin 8.1. The gripper 9 is fixed to the hinge 8. The gripper 9, at an end that attaches onto the hinge 8, bears conical arms 9.1 that run parallel to the longitudinal axis of the gripper 9. The arms 9.1 slide into conical guides 8.2 in the end of the hinge 8. The joining of the gripper 9 and the hinge 8 is adjustable by the force exerted by grains 10 that, due to the conical shape of the arms 9.1 and guides 8.2, work both vertically and laterally. This joining ensures that the gripper 9 and hinge 8 are safely fastened, and, if need be, the gripper 9 can be moved, once the grains 10 have been loosened, to better position both the gripper 9 and the pane 1 that is fixed to the gripper 9 within the space available.

The gripper 9 also bears a groove 9.2. The groove 9.2 runs parallel to the longitudinal axis of the gripper 9 and is situated on an arm of the gripper 9 that points towards a closing section bar 11. An end of a plastic gasket 12 fits into the groove 9.2. The gasket 12 bridges the gap between the gripper 9 and the closing section bar 11. The closing section bar 11 is fixed to the hinge-bearing section bar 6 and lies facing the gripper 9 when the pane 1 is closed.

Figure 2:
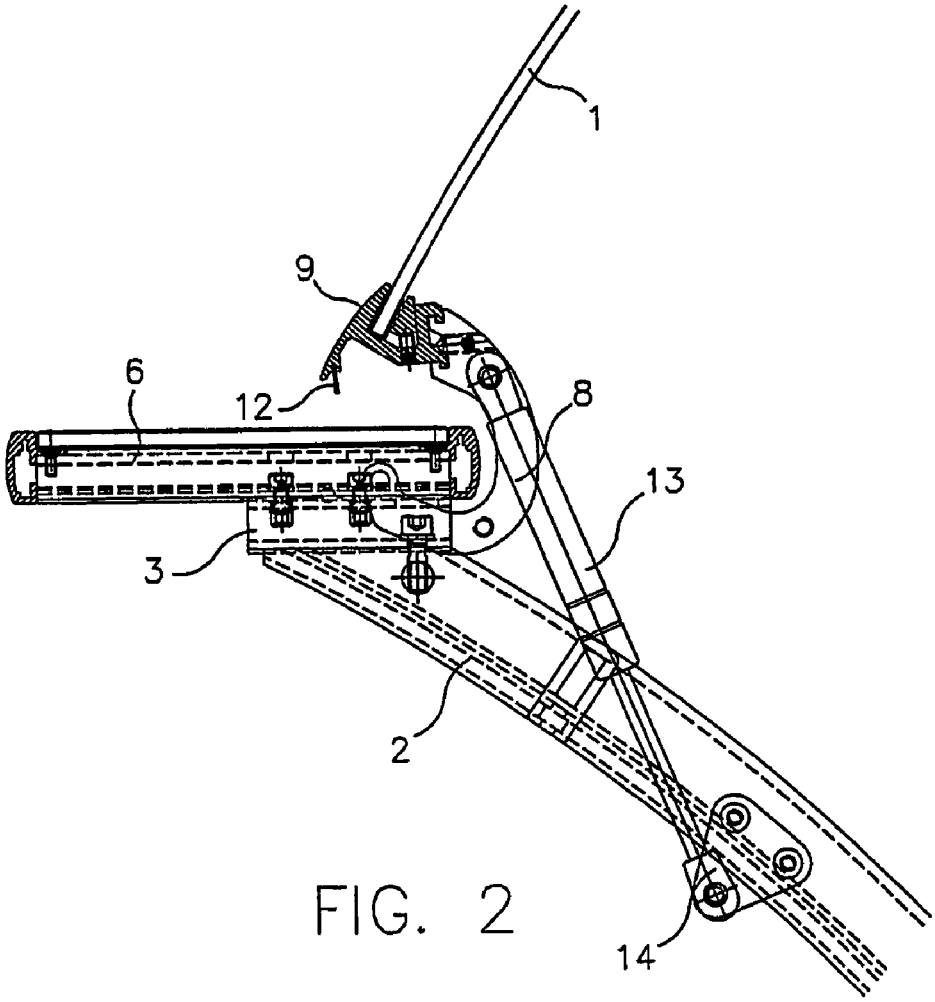
FIG. 2 illustrates the same section of the superstructure as FIG. 1 with the curved pane lifted.
Figure 3:
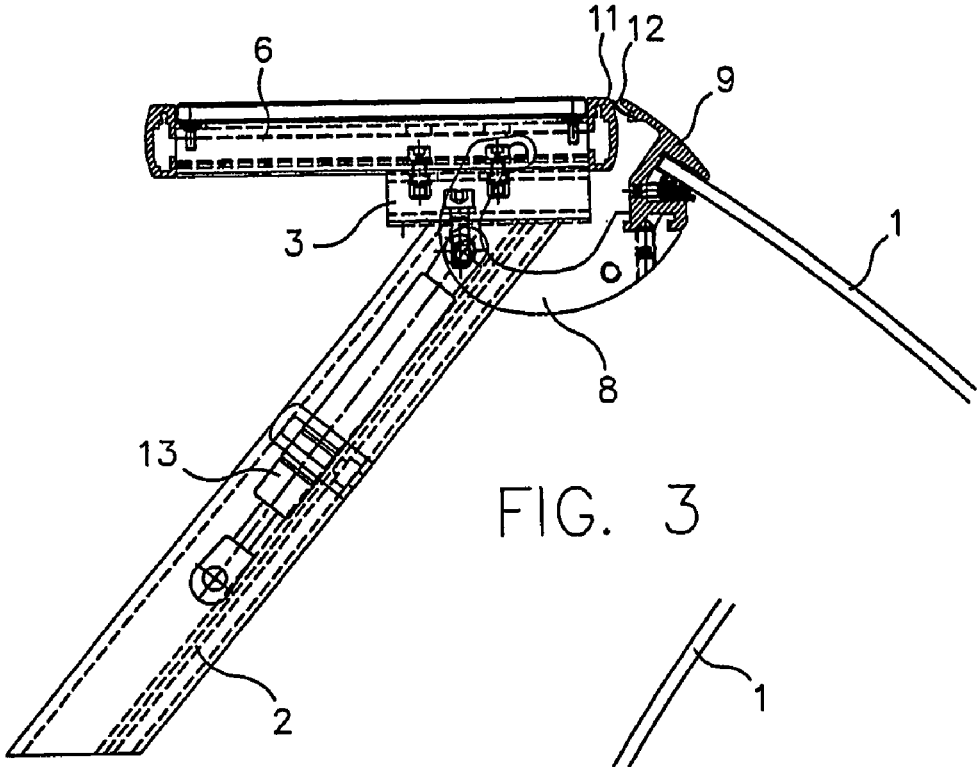
FIG. 3 depicts a section of the present superstructure attached to a side back upright of a display unit.
Figure 4:
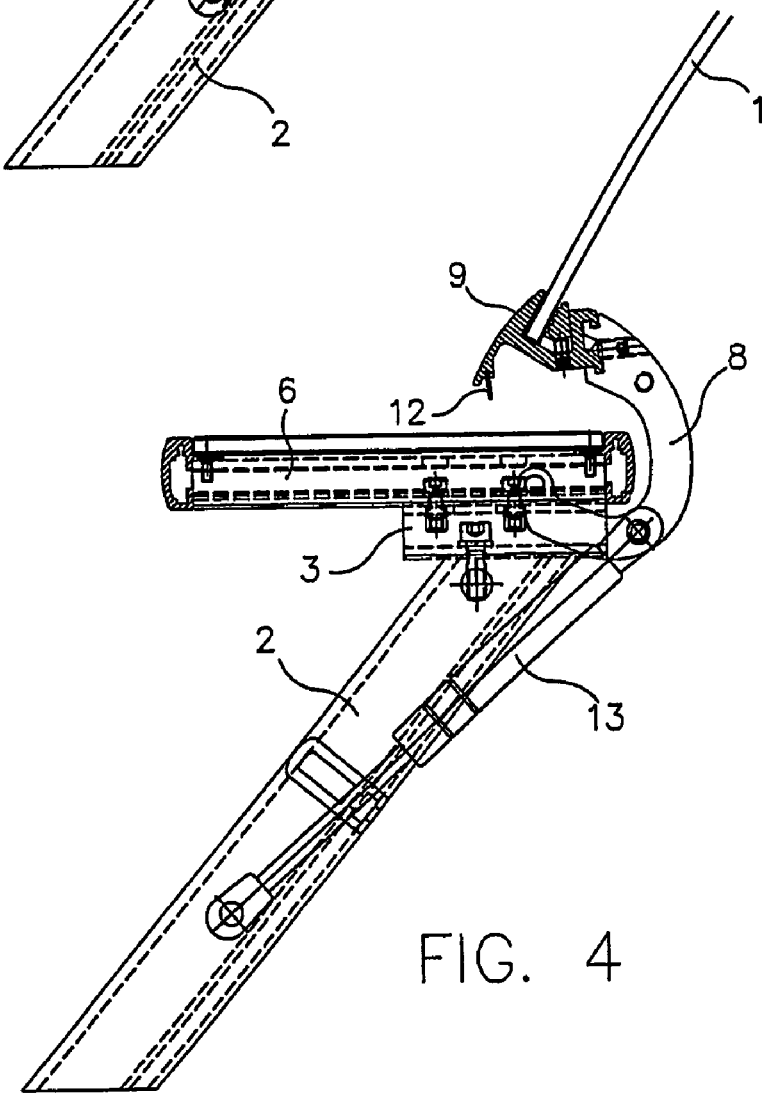
FIG. 4 illustrates the same section of the superstructure as FIG. 3 with the pane even more lifted.

One end of a piston 13 that helps lift the pane 1 is fixed to the hinge 8. The other end of the piston 13 is fixed onto the front upright 2 by means of a bracket 14, as shown in FIGS. 1 and 2. When using a back upright 2, as can be seen in FIGS. 3 and 4, the second end of the piston 13 is attached directly to the back upright 2.

When a display unit has a spherical pane 1, hinges 15, as shown in FIGS. 12-17, are used. Each hinge includes a body 15.1 and a connecting piece 15.2. The body 15.1 is generally semicircular and bears an insert 15.3 into which a base of the connecting piece 15.2 fits. The connecting piece 15.2 is fixed to the body 15.1 by means of screws that fit into holes 15.4 and 15.5. The connecting piece 15.2 is composed of a plate, and a crop of a section bar containing conical guides 15.6 that fit the conical arms 9.1 situated on the gripper 9 is fixed onto the plate by means of screws. The body 15.1 is hinged to an adapting piece 15.7 by means of a pin 15.8 that passes through a hole 15.9. The adapting piece 15.7 is fixed to the section bar 6.

Figure 15:
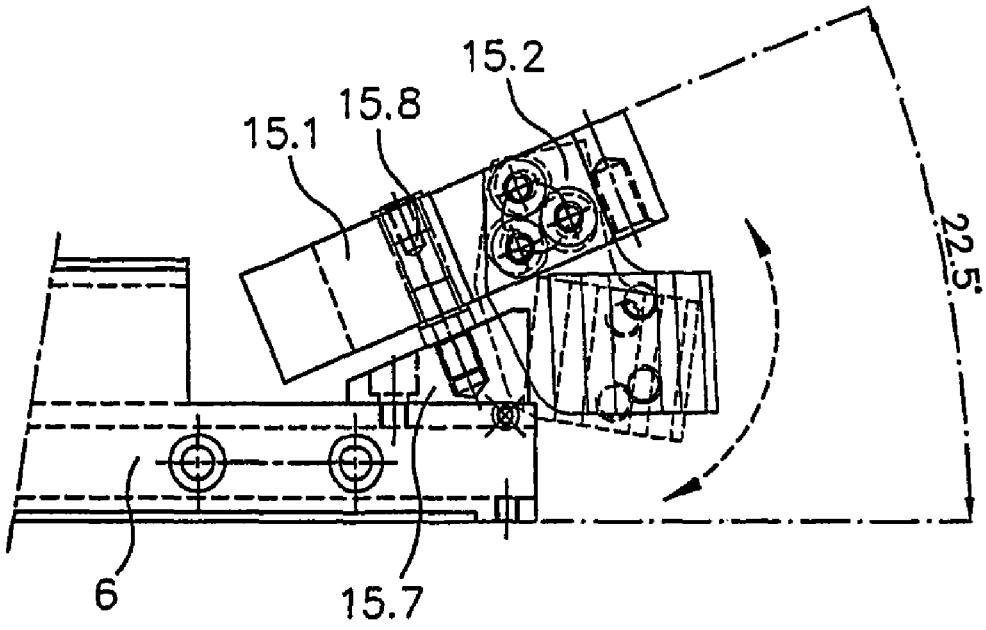
FIG. 15 depicts a top view of the hinge, showing the possibility for maneuver of the connecting piece.
Figure 16:
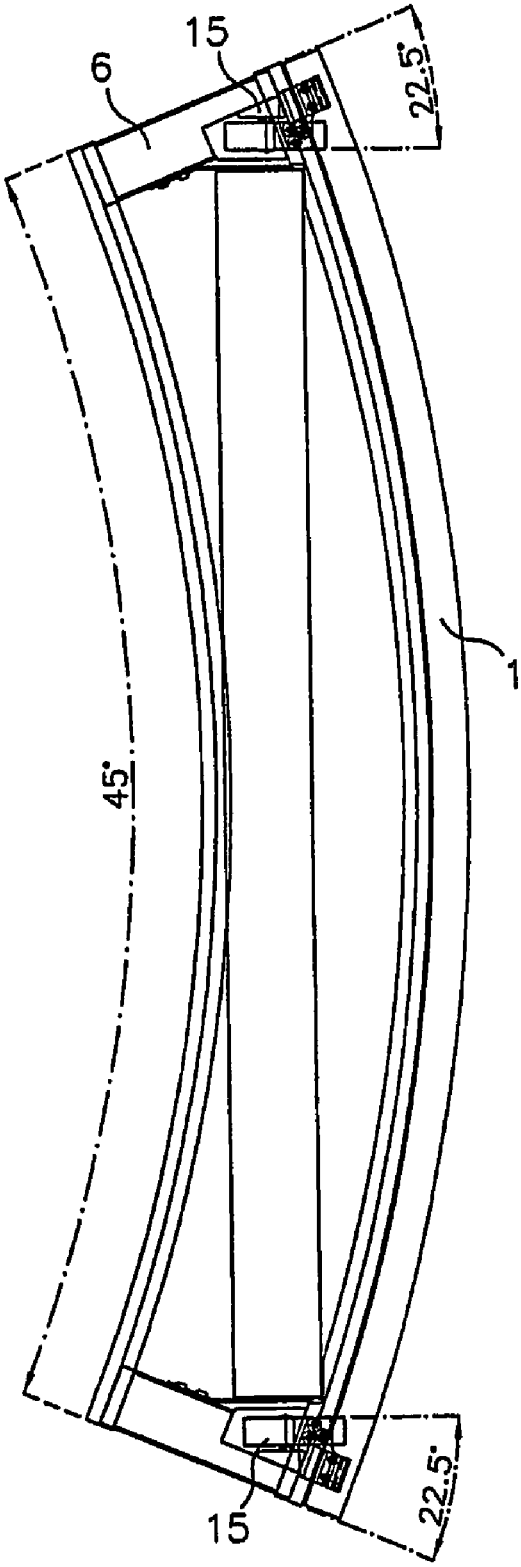
FIGS. 16 and 17 depict a top view of two curved panes with different opening angles, and fixed to the present superstructure.
Figure 17:
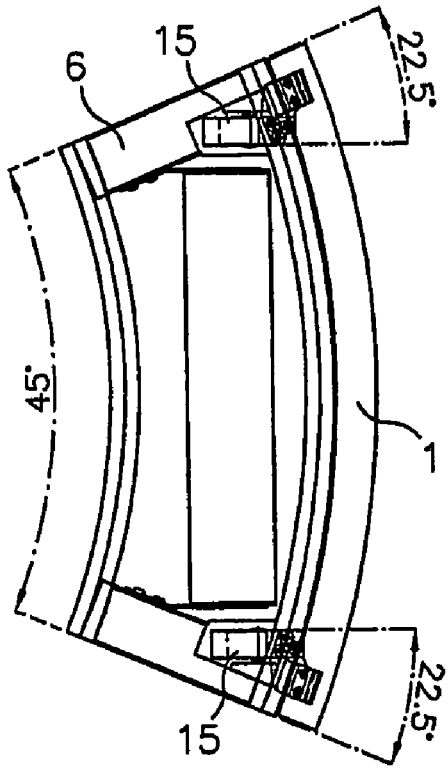

Unlike the hinges 8, the longitudinal axis of the conical guides in the hinges 15 is not orthogonal but is instead incident to the longitudinal axis of the hinge 15. The base of the connecting piece 15.2 can be rotated with respects to the body 15.1 so that the same hinges 15 may be used for panes 1 having different opening angles without interfering with the hinge-bearing section bar 6. For example, the opening angle of panes 1 shown in FIG. 16 is more than twice the size of the opening angle of the panes 1 shown in FIG. 17. However, while the panes 1 share the same length of the circular arc and are fixed to the present superstructure using the hinges 15, different opening angles can be obtained by rotating the connecting elements 15.2 ever so slightly with respect to their respective bodies 15.1, as illustrated in FIG. 15. For variations in length of the circular arc of the panes 1 that are above 5%, the body 15.1 must be replaced with another body containing an insert 15.3 of a different shape.

The invention claimed is:

1. A superstructure for lifting of panes (1) in display units containing panes (1) and uprights (2), wherein each pane (1) is situated on a customer side, the superstructure comprising: for each upright (2), a spacer section bar (3), a hinge-bearing section bar (6), at least one hinge (8, 15) that is generally semicircular, at least one piston (13) that helps with the lifting of the pane (1), a gripper (9) for supporting the pane (1), a closing section bar (11) fixed to the hinge-bearing section bar (6), and a gasket, the hinge-bearing section bar (6) being fixed above the section bar (3) by means of screws (7), each hinge (8, 15) being hinged onto the section bar (6) by means of a pin (8.1), the upright (2), front or back, being fixed to the spacer section bar (3) by means of a pin and screws assembly wherein a pin (4) is inserted into a hole in the upright (2) and screws (5) pass through a lower wall of the spacer section bar (3) into the pin (4), one end of the at least one piston (13) being fixed to the hinge (8, 15), an other end of the at least one piston (13) being fixed onto a bracket (14) fixed to the upright (2) when a front upright is involved or directly to the upright (2) when a back upright is involved, the spacer section bar (3) bearing bottom fins (3.1) on a lower side of the spacer section bar (3) that run parallel to a longitudinal axis of the spacer section bar (3), the bottom fins (3.1) bounding a bottom guide (3.2) into which a top end of the upright (2) is inserted, the spacer section bar (3) bearing top fins (3.3) on a top side of the spacer section bar (3) that run parallel to the longitudinal axis of the spacer section bar (3), the top fins (3.3) bounding a top guide (3.4), the hinge-bearing section bar (6) containing a guide projection (6.1) on a lower area of the hinge-bearing section bar (6), the guide projection (6.1) fitting into the top guide (3.4) on the spacer section bar (3), the screws (7) that fix the hinge-bearing section bar (6) to the spacer section bar (3) being inserted into slots situated in an area where the two section bars (3, 6) join and fasten together, an end of the hinge (8, 15) fixed to the gripper (9) bearing conical guides (8.2, 15.6), an end of the gripper (9) fixed to the hinge (8, 15) having conical arms (9.1), the conical arms (9.1) running parallel to a longitudinal axis of the gripper (9), the arms (9.1) fitting into the guides (8.2, 15.6) on the hinge (8, 15) so the joining together of the gripper (9) and the hinge (8, 15) is controlled by grains (10), the gripper (9) having a groove (9.2) which runs parallel to the longitudinal axis of the gripper (9) on an arm of the gripper (9) that points toward the closing section bar (11), one end of a plastic gasket (12) fitting into the groove (9.2), an other end of the plastic gasket (12) running along the closing section bar (11).

2. A superstructure according to claim 1, wherein the bottom fins (3.1) on the spacer section bar (3) can be present either on both sides of the section bar (3), or only along one side, depending on whether the section bar (3) is being used for central or side uprights.

3. A superstructure according to claim 2, wherein the bottom fins (3.1) are only present along a left or a right side of the spacer section bar (3), to be fixed to left or right side uprights.

4. A superstructure according to claim 1, wherein the panes (1) are spherical and wherein the hinge (15) has a generally semicircular body (15.1) and a connecting piece (15.2), the body (15.1) bearing an insert (15.3) into which a base of the connecting piece (15.2) fits, a connection of the body (15.1) to the connecting piece (15.2) being achieved by means of screws that are lodged into holes (15.4, 15.5) on both of the body (15.1) and the connecting piece (15.2), the connecting piece (15.2) bearing the conical guides (15.6) that fit the conical arms (9.1) of the gripper (9), a longitudinal axis of each conical guide (15.6) being incident to a longitudinal axis of the body (15.1), the base of the connecting piece (15.2) being rotatable with respect to the body (15.1) so that the spherical panes (1) can be fitted onto the hinges (15) at different lengths of a circular arc without interfering with the hinge-bearing section bar (6).

5. A superstructure according to claim 4, wherein when the spherical panes (1) each have a different length of the circular arc, the body (15.1) can be replaced without interfering with the hinge-bearing section bar (6).

6. A superstructure according to claim 4, wherein the body (15.1) is hinged onto an adapting piece (15.7) by means of a pin (15.8) that passes through a hole (15.9), the adapting piece (15.7) being fixed to the section bar (6).

7. A superstructure according to claim 4, wherein the connecting piece (15.2) includes a plate and a section bar containing conical guides (15.6), the section bar being fixed to the plate by means of screws.

* * * * *